US011399614B2

(12) United States Patent
Lee

(10) Patent No.: US 11,399,614 B2
(45) Date of Patent: Aug. 2, 2022

(54) AIRLESS COSMETIC CONTAINER

(71) Applicant: SAMHWA CO., LTD., Uiwang-si Gyeonggi-do (KR)

(72) Inventor: Kyung Chang Lee, Uiwang-si Gyeonggi-do (KR)

(73) Assignee: SAMHWA CO., LTD., Uiwang-si (KR)

( * ) Notice: Subject to any disclaimer, the term of this patent is extended or adjusted under 35 U.S.C. 154(b) by 0 days.

(21) Appl. No.: 17/274,291

(22) PCT Filed: Oct. 19, 2018

(86) PCT No.: PCT/KR2018/012418
§ 371 (c)(1),
(2) Date: Mar. 8, 2021

(87) PCT Pub. No.: WO2020/050452
PCT Pub. Date: Mar. 12, 2020

(65) Prior Publication Data

US 2021/0353034 A1 Nov. 18, 2021

(30) Foreign Application Priority Data

Sep. 6, 2018 (KR) ..... 10-2018-0106222
Sep. 6, 2018 (KR) ..... 10-2018-0106223

(51) Int. Cl.
*A45D 34/00* (2006.01)
*B05B 11/00* (2006.01)

(52) U.S. Cl.
CPC ..... *A45D 34/00* (2013.01); *B05B 11/3001* (2013.01); *B05B 11/3045* (2013.01);
(Continued)

(58) Field of Classification Search
CPC ..... A45D 34/00; A45D 2200/051; A45D 2200/055; A45D 2200/056; A45D 34/04;
(Continued)

(56) References Cited

U.S. PATENT DOCUMENTS

2012/0305606 A1* 12/2012 Lee ..... B05B 11/3011 222/256
2016/0015149 A1* 1/2016 Kim ..... A45D 33/008 222/383.1

(Continued)

FOREIGN PATENT DOCUMENTS

KR 10-1171305 B1 8/2012
KR 10-2015-0039434 A 4/2015

(Continued)

OTHER PUBLICATIONS

KR 20150039434 with Machine Translation (Year: 2015).*
KR 20160093352 with Machine Translation (Year: 2016).*
WO2017146408 (Year: 2017).*

*Primary Examiner* — Vishal Pancholi
(74) *Attorney, Agent, or Firm* — Novick, Kim & Lee, PLLC; Jae Youn Kim

(57) ABSTRACT

The present invention relates to an airless cosmetic container comprising: a lower container (10) having an opened lower part; an inner container (20) which is a cylindrical member inserted through the upper opening of the lower container (10) and having a closed lower part, and which has an upper outer flange (21) mounted on and assembled to the upper end of the lower container (10); a container cover (30) which is a cylindrical member for covering the upper opening of the inner container (20), and of which a lower protruding groove (31) protruding downwards from the center thereof is positioned in a cylinder (22) protruding from the center of the inner container (20) and an outer end (32) is coupled to two vertical protruding rods (23) protruding toward the upper part of the upper outer flange (21) of the inner container (20); a cylindrical spring (40) coupled in the container cover (30); a disc-shaped upper lid (50), having a recessed upper surface, coupled to the upper part of the cylindrical spring
(Continued)

(40); a disc-shaped lower lid (60), which is a member coupled to the lower surface of the center of the upper lid (50), has a discharge hole (61) formed in the center thereof, and has a fastening cylinder (62) formed at the lower part of the discharge hole (61); a pump body (70) coupled to the fastening cylinder (62) of the lower lid (60) and inserted into the lower protruding groove (31) of the container cover (30); an exhaustion piston (80) coming in close contact with the inner periphery of the inner container (20) and the outer periphery of the cylinder (22) protruding in the center thereof, so as to rise as cosmetic contents are used; and an upper case (100) which is a cylindrical member for covering the upper side of the lower container (10), and of which one side is hinge-coupled to one side wall of the lower container (10) and the other side is hooked and coupled to an opening/closing button (90). The present invention has effects of: preventing external air from flowing into an upper cylinder since the inner diameter of the discharge hole is formed to be smaller than the inner diameter of the fastening cylinder of the lower lid such that, when a piston support and the lower lid are coupled, the upper end surface of a center hole of the piston support comes in close contact with, that is, overlaps with the lower surface of the discharge hole in the fastening cylinder of the lower lid, so as to reinforce fastening force; and enabling cosmetic contents to be fully exhausted and used up without waste since a coupling protrusion is formed on the outer periphery of the outer vertical protruding rod from among the two vertical protruding rods of the inner container such that the outer side of the upper part of the container cover is firmly coupled thereto, and a gap, that is, an evacuation space is formed between the inner periphery of the inner container and the outer periphery of the lower part of the container cover such that the upper end of the exhaustion piston raised along the inner periphery of the inner container is inserted therein, and thus the upper end of the exhaustion piston is inserted into the evacuation space.

4 Claims, 7 Drawing Sheets

(52) U.S. Cl.
CPC .... *B05B 11/3069* (2013.01); *A45D 2200/051* (2013.01); *A45D 2200/055* (2013.01); *A45D 2200/056* (2013.01)

(58) Field of Classification Search
CPC . A45D 33/02; B05B 11/3001; B05B 11/3045; B05B 11/3069; B65D 25/02; B65D 43/16; B65D 83/00
See application file for complete search history.

(56) References Cited

U.S. PATENT DOCUMENTS

| | | | | |
|---|---|---|---|---|
| 2016/0073761 | A1* | 3/2016 | Lee | A45D 33/006 132/298 |
| 2017/0056905 | A1* | 3/2017 | Lee | A45D 33/025 |
| 2018/0184786 | A1* | 7/2018 | Lee | B05B 1/18 |
| 2018/0295967 | A1* | 10/2018 | Byeon | B65D 83/0005 |

FOREIGN PATENT DOCUMENTS

| | | | |
|---|---|---|---|
| KR | 10-1594275 | B1 | 2/2016 |
| KR | 10-1663782 | B1 | 10/2016 |
| KR | 10-1663927 | B1 | 10/2016 |
| KR | 20-2017-0002211 | U | 6/2017 |

* cited by examiner

AIRLESS COSMETIC CONTAINER

TECHNICAL FIELD

The present disclosure relates to an airless cosmetic container. More particularly, the present disclosure relates to an airless cosmetic container, intended to maintain air-tightness between a piston rod of a pump body and upper and lower lids, and to secure an evacuation space for raising a piston used to exhaust cosmetic contents.

BACKGROUND ART

As described in Korean Patent Application No. 2015-0065802, cosmetics usually contain a large amount of volatile components such as moisture or alcohol, so that the moisture may be evaporated and the volatile components may be volatilized if the cosmetic container is not completely sealed due to the moisture or the volatile components, thus leading to a reduction in the amount of the cosmetics. Further, a mixing ratio between cosmetic components is changed due to the evaporation of the moisture or the volatilization of the volatile components, so that the performance of the cosmetics is deteriorated.

Moreover, if the moisture is evaporated or the volatile components are volatilized, the cosmetics are dried up, and the original function of the cosmetics is lost. Thus, it is very important to always maintain the original components of the cosmetics.

To this end, a conventional cosmetic container is equipped with an airtight lid that maintains air-tightness to prevent the evaporation of the moisture and the volatilization of the volatile components. The conventional cosmetic container is generally equipped with an elastic packing to maintain the air-tightness of the cosmetic container containing the cosmetics, thus securing the air-tightness.

DISCLOSURE

Technical Problem

Accordingly, the present disclosure has been made keeping in mind the above problems occurring in the related art, and is intended to provide an airless cosmetic container, capable of maintaining air-tightness between a piston rod of a pump body and upper and lower lids, and of securing an evacuation space for raising a piston used to exhaust cosmetic contents.

Technical Solution

In order to accomplish the above-described object, the present disclosure provides an airless cosmetic container, including a lower container having an opened lower part; an inner container which is a cylindrical member inserted through an upper opening of the lower container and having a closed lower part, and which has an upper outer flange mounted on and assembled to an upper end of the lower container; a container cover which is a cylindrical member for covering the upper opening of the inner container, and of which a lower protruding groove protruding downwards from a center thereof is positioned in a cylinder protruding from a center of the inner container and an outer end is coupled to two vertical protruding rods protruding toward an upper part of the upper outer flange of the inner container; a cylindrical spring coupled in the container cover; a disc-shaped upper lid, having a recessed upper surface, coupled to an upper part of the cylindrical spring; a disc-shaped lower lid, which is a member coupled to a lower surface of a center of the upper lid, has a discharge hole formed in the center thereof, and has a fastening cylinder formed at a lower part of the discharge hole; a pump body coupled to the fastening cylinder of the lower lid and inserted into the lower protruding groove of the container cover; an exhaustion piston coming in close contact with an inner periphery of the inner container and an outer periphery of the cylinder protruding in the center thereof, so as to rise as cosmetic contents are used; and an upper case which is a cylindrical member for covering an upper side of the lower container, and of which one side is hinge-coupled to one side wall of the lower container and the other side is hooked and coupled to an opening/closing button.

Furthermore, an inner diameter of the discharge hole may be formed to be smaller than an inner diameter of the fastening cylinder of the lower lid, so that, when a piston support of the pump body is coupled to the lower lid, an upper end surface of a center hole of the piston support may be in close contact with a lower surface of the discharge hole in the fastening cylinder of the lower lid.

A coupling protrusion may be formed on an outer periphery of an outer vertical protruding rod among two vertical protruding rods of the inner container so that an outer side of an upper part of the container cover is firmly coupled thereto. A gap may be formed between the inner periphery of the inner container and an outer periphery of a lower part of the container cover so that an upper end of the exhaustion piston rising from the inner periphery of the inner container may be inserted.

A hole of the disc-shaped upper lid may be formed of six holes, which are longitudinal holes having an inclination of 60° between major axes thereof.

Advantageous Effects

An airless cosmetic container of the present disclosure has effects of: preventing external air from flowing into an upper cylinder since the inner diameter of a discharge hole is formed to be smaller than the inner diameter of a fastening cylinder of a lower lid such that, when a piston support and the lower lid are coupled, the upper end surface of a center hole of the piston support comes in close contact with, that is, overlaps with the lower surface of the discharge hole in the fastening cylinder of the lower lid, so as to reinforce fastening force; and enabling cosmetic contents to be fully exhausted and used up without waste since a coupling protrusion is formed on the outer periphery of an outer vertical protruding rod among two vertical protruding rods of the inner container such that the outer side of the upper part of the container cover is firmly coupled thereto, and a gap, that is, an evacuation space is formed between the inner periphery of the inner container and the outer periphery of the lower part of the container cover such that the upper end of the exhaustion piston raised along the inner periphery of the inner container is inserted therein, and thus the upper end of the exhaustion piston is inserted into the evacuation space.

BEST MODE

Figure 1:
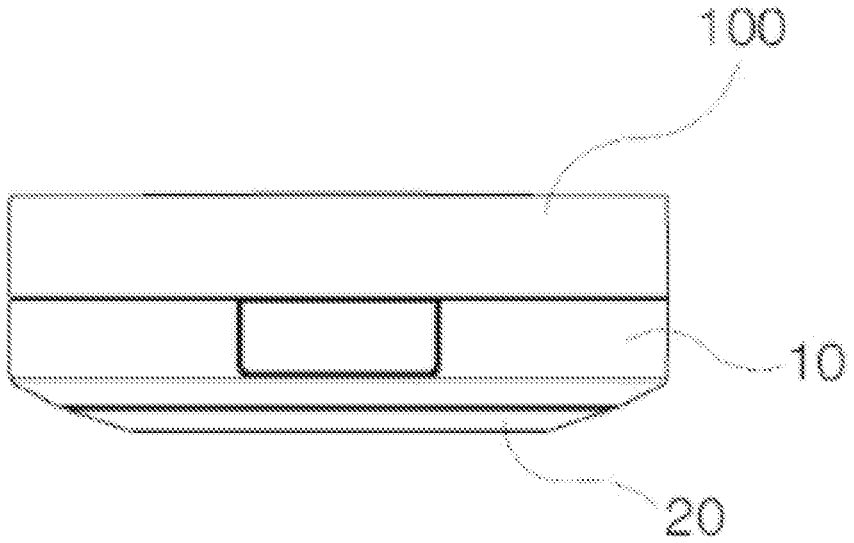
FIG. 1 is a front view illustrating a cosmetic container according to the present disclosure.

An airless cosmetic container according to a first embodiment of the present disclosure may include a lower container having an opened lower part; an inner container which is a cylindrical member inserted through an upper opening of the lower container and having a closed lower part, and which has an upper outer flange mounted on and assembled to an upper end of the lower container; a container cover which is a cylindrical member for covering the upper opening of the inner container, and of which a lower protruding groove protruding downwards from a center thereof is positioned in a cylinder protruding from a center of the inner container and an outer end is coupled to two vertical protruding rods protruding toward an upper part of the upper outer flange of the inner container; a cylindrical spring coupled in the container cover; a disc-shaped upper lid, having a recessed upper surface, coupled to an upper part of the cylindrical spring; a disc-shaped lower lid, which is a member coupled to a lower surface of a center of the upper lid, has a discharge hole formed in the center thereof, and has a fastening cylinder formed at a lower part of the discharge hole; a pump body coupled to the fastening cylinder of the lower lid and inserted into the lower protruding groove of the container cover; an exhaustion piston coming in close contact with an inner periphery of the inner container and an outer periphery of the cylinder protruding in the center thereof, so as to rise as cosmetic contents are used; and an upper case which is a cylindrical member for covering an upper side of the lower container, and of which one side is hinge-coupled to one side wall of the lower container and the other side is hooked and coupled to an opening/closing button.

Hereinafter, preferred embodiments of the present disclosure will be described with reference to the accompanying drawings such that those skilled in the art can easily practice the present disclosure. It is to be noted that the same reference numerals are used throughout the drawings to designate the same or similar components. When it is determined that the detailed description of known function or known configuration related to the present disclosure may obscure the gist of the present disclosure, the detailed description will be omitted. For the ease of description, certain features shown in the drawings may be exaggerated or simplified, and drawings and components are not necessarily drawn to scale. Those skilled in the art will readily understand these details.

It will be understood that, although the terms "first", "second", etc. may be used herein to describe various components, these components should not be limited by these terms. These terms are only used to distinguish one component from another component. For instance, a first component could be termed a second component without departing from the teachings of the present disclosure. Similarly, the second component could also be termed the first component. In the present disclosure, the terms "and/or" are intended to include a combination of plural referents or any one of the plural referents.

Furthermore, relative terms "front", "rear", "top", and "bottom" indicated on the basis of the drawings will be replaced with ordinal numbers, such as "first" or "second".

The order indicated by the ordinal numerals "first", "second", etc. is a mentioned order or any order. This order may be changed as necessary.

It is to be understood that terms used herein are employed to describe specific embodiments and are not intended to limit the present disclosure. In the present disclosure, the singular forms are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which the present disclosure belongs. It will be further understood that terms used herein should be interpreted as having a meaning that is consistent with their meaning in the context of this specification and the relevant art and will not be interpreted in an idealized or overly formal sense unless expressly so defined herein.

Hereinafter, the preferred embodiments of the present disclosure will be described in detail with reference to the accompanying drawings. In addition, when it is determined that the detailed description of known configuration or function related to the present disclosure may obscure the gist of the present disclosure, the detailed description will be omitted.

Embodiment

Figure 2:
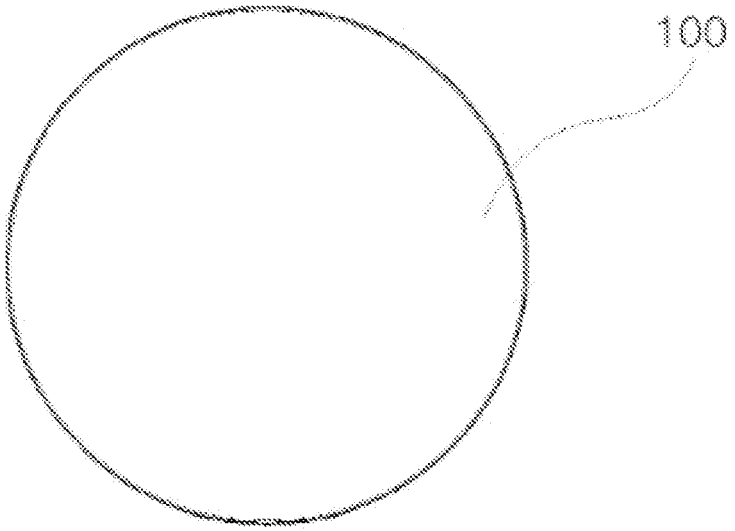
FIG. 2 is a plan view illustrating the cosmetic container according to the present disclosure.
Figure 3:
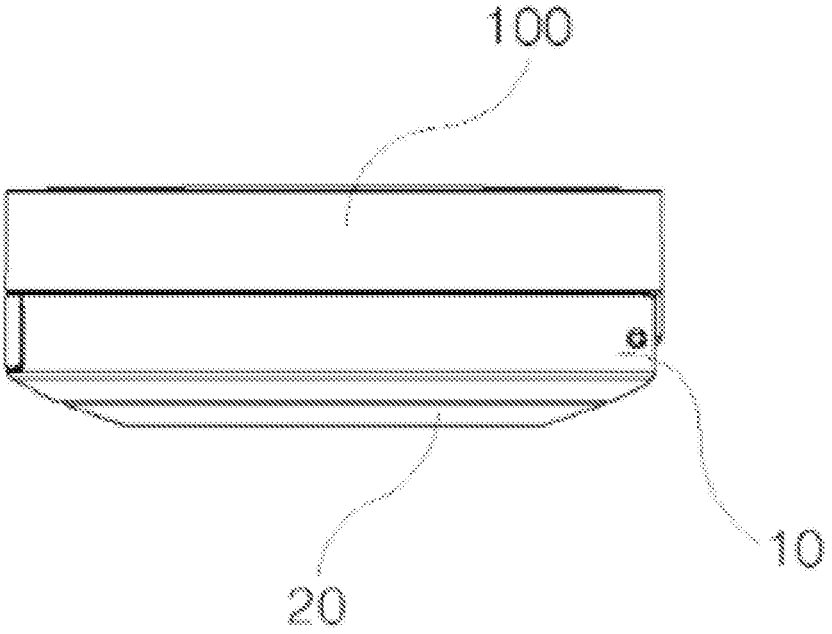
FIG. 3 is a side view illustrating the cosmetic container according to the present disclosure.
Figure 4:
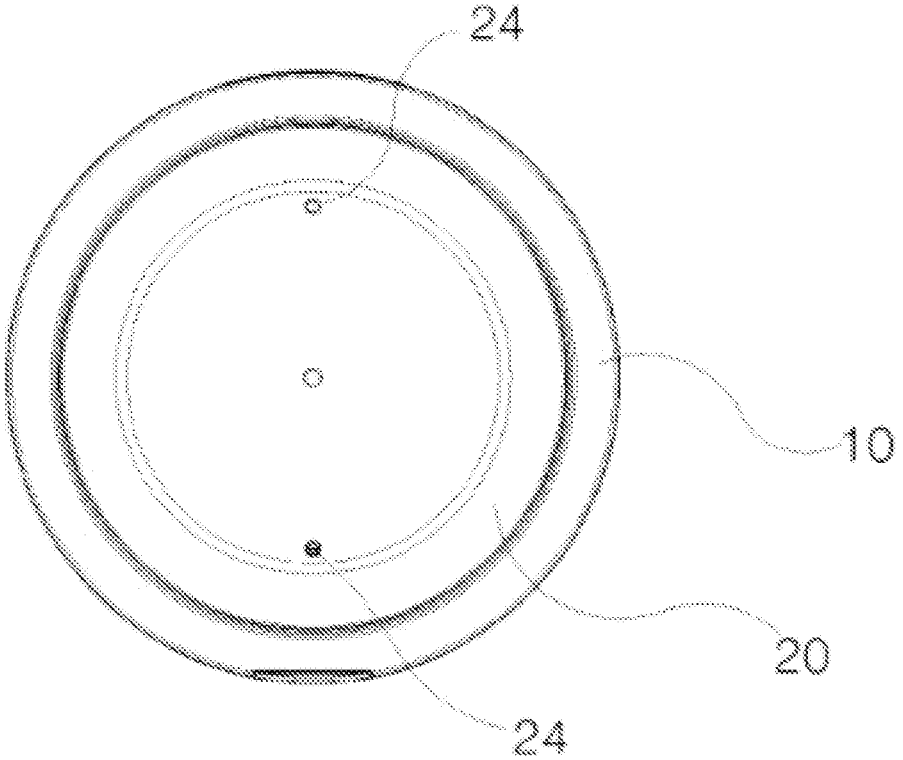
FIG. 4 is a bottom view illustrating the cosmetic container according to the present disclosure.
Figure 5:
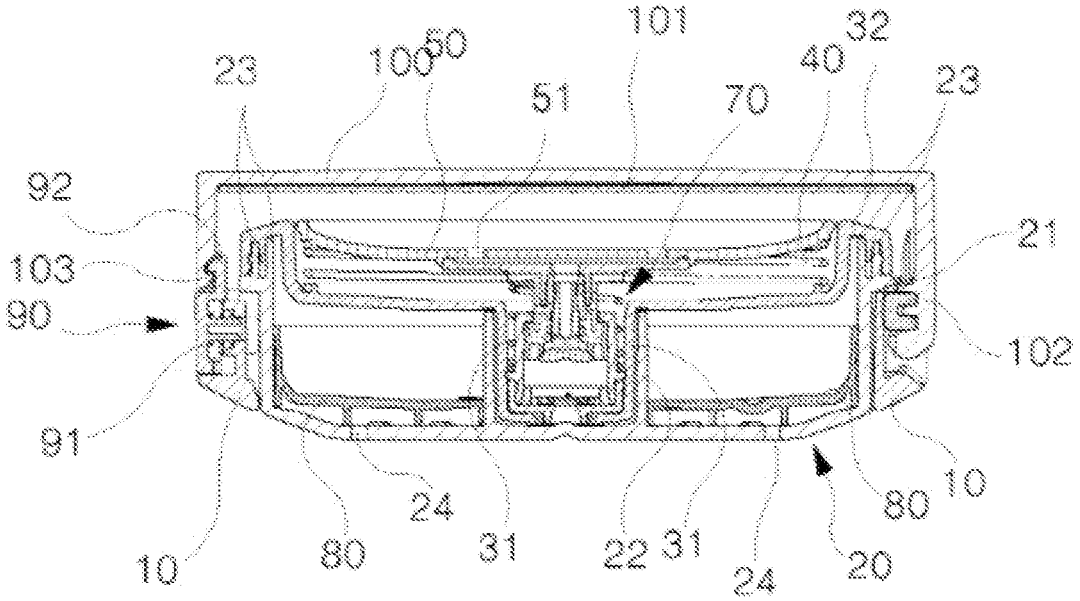
FIG. 5 is a sectional view illustrating the cosmetic container according to the present disclosure when in assembly.
Figure 6:
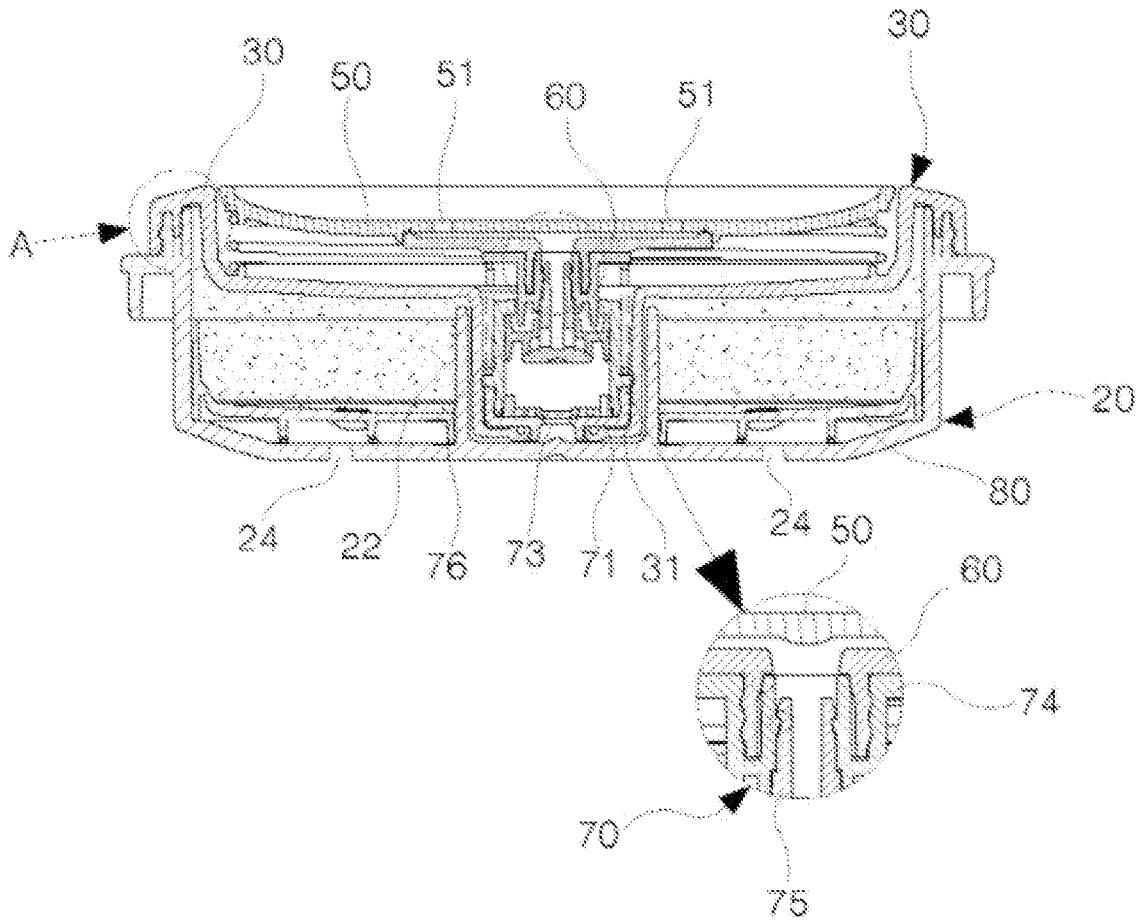
FIG. 6 is a detailed sectional view illustrating the interior of the cosmetic container according to the present disclosure.
Figure 7:
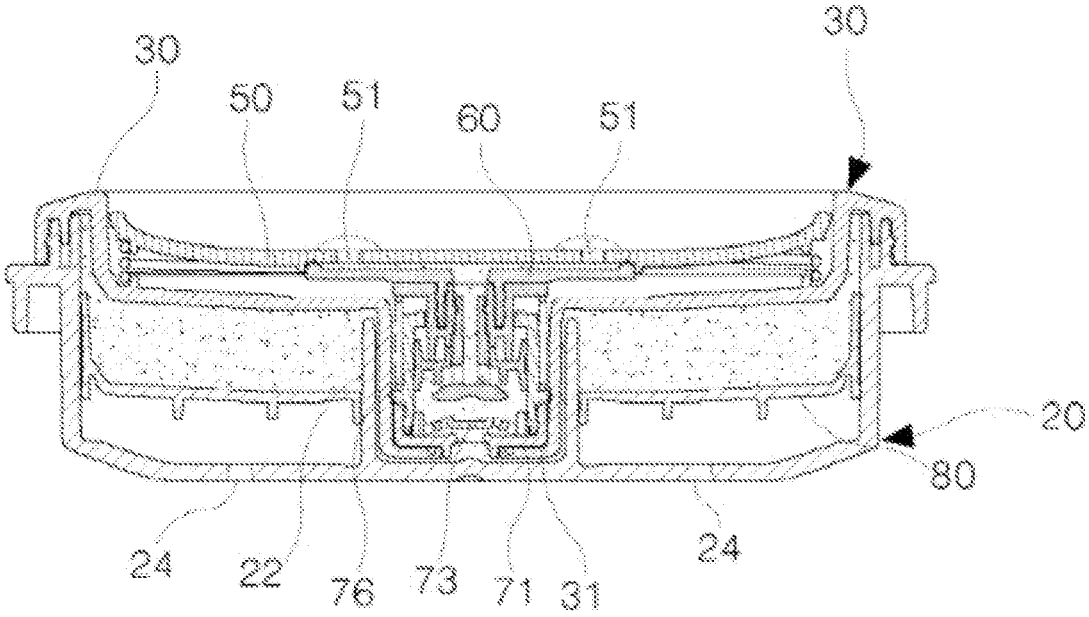
FIG. 7 is a detailed sectional view illustrating the interior of the cosmetic container according to the present disclosure when in operation.
Figure 8:
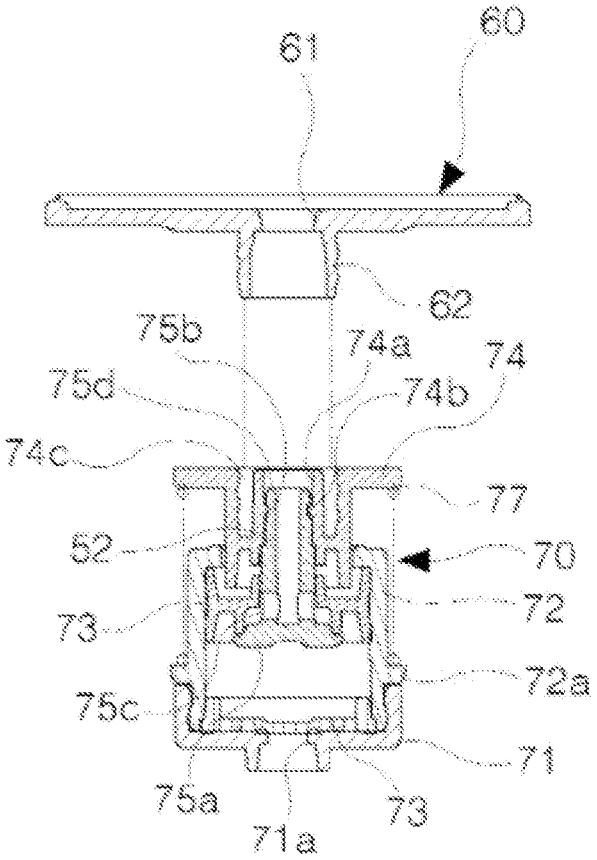
FIG. 8 is an exploded sectional view illustrating a lid button and a pump of the cosmetic container according to the present disclosure.
Figure 9:
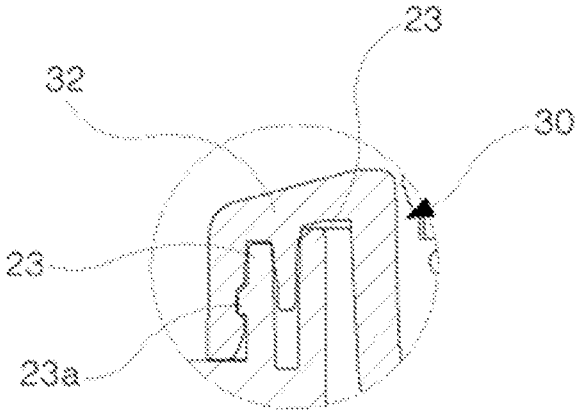
FIGS. 9 and 10 are detailed sectional views illustrating part A of FIG. 3.
Figure 10:
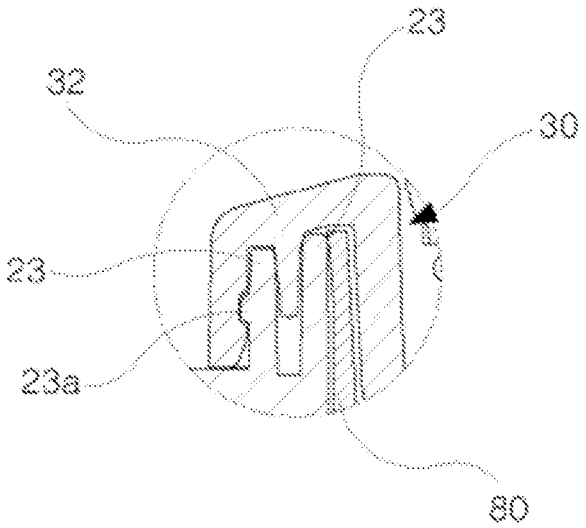
Figure 11:
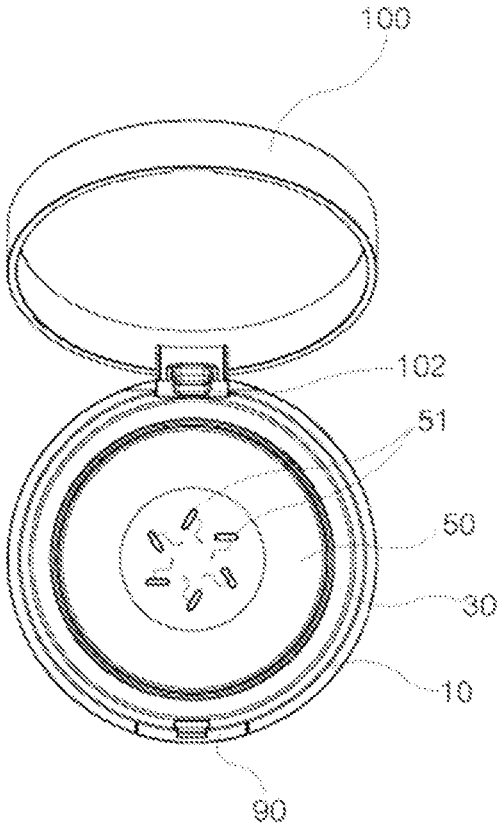
FIG. 11 is a plan view illustrating the interior of the cosmetic container according to the present disclosure.

FIG. 1 is a front view illustrating a cosmetic container according to the present disclosure, FIG. 2 is a plan view illustrating the cosmetic container according to the present disclosure, FIG. 3 is a side view illustrating the cosmetic container according to the present disclosure, FIG. 4 is a bottom view illustrating the cosmetic container according to the present disclosure, FIG. 5 is a sectional view illustrating the cosmetic container according to the present disclosure when in assembly, FIG. 6 is a detailed sectional view illustrating the interior of the cosmetic container according to the present disclosure, FIG. 7 is a detailed sectional view illustrating the interior of the cosmetic container according to the present disclosure when in operation, FIG. 8 is an exploded sectional view illustrating a lid button and a pump of the cosmetic container according to the present disclosure, FIGS. 9 and 10 are detailed sectional views illustrating part A of FIG. 3, and FIG. 11 is a plan view illustrating the interior of the cosmetic container according to the present disclosure.

The configuration of the airless cosmetic container according to the present disclosure will be described below with reference to the accompanying drawings.

The airless cosmetic container of the present disclosure may include a lower container 10 having opened upper and lower parts, and an inner container 20 which is a cylindrical member inserted through an upper opening of the lower container 10 and having a closed lower part, and which has an upper outer flange 21 mounted on and assembled to an upper end of the lower container 10.

The airless cosmetic container may include a container cover 30 which is a cylindrical member for covering the upper opening of the inner container 20, and of which a lower protruding groove 31 protruding downwards from a center thereof is positioned in a cylinder 22 protruding from a center of the inner container 20 and an outer end 32 is coupled to two vertical protruding rods 23 protruding toward an upper part of the upper outer flange 21 of the inner container 20, a cylindrical spring 40 coupled in the container cover 30, a disc-shaped upper lid 50, having a recessed upper surface, coupled to an upper part of the cylindrical spring 40, a disc-shaped lower lid 60, which is a member coupled to a lower surface of a center of the upper lid 50, has a discharge hole 61 formed in the center thereof, and has a fastening cylinder 62 formed at a lower part of the discharge hole 61, a pump body 70 coupled to the fastening cylinder 62 of the lower lid 60 and inserted into the lower protruding groove 31 of the container cover 30, an exhaustion piston 80 coming in close contact with an inner periphery of the inner container 20 and an outer periphery of the cylinder 22 protruding in the center thereof, so as to rise as cosmetic contents are used, and an upper case 100 which is a cylindrical member for covering an upper side of the lower container 10, and of which one side is hinge-coupled to one side wall of the lower container 10 and the other side is hooked and coupled to an opening/closing button 90.

A mirror 101 is attached to a lower surface of the upper case 100, and a tension rubber 102 is inserted between an outer side wall of the lower container 10 and an inner side wall of the upper case 100 to seal a gap therebetween.

When the opening/closing button 90 is horizontally pressed against the lower container 10, the button spring 91 is compressed and a locking protrusion 92 provided on an upper end thereof is removed from a locking groove 103 of the upper case 100, thus opening the upper case 100.

The pump body 70 may include a lower cylinder 71 which is a cylindrical member inserted into and coupled to a bottom in the lower protruding groove 31 of the container cover 30, is opened at a top thereof, and has a cosmetic-content inflow hole 71*a* formed in a center of a lower part thereof, an upper cylinder 72 which is a cylindrical member opened at upper and lower parts thereof coupled to an inner periphery of the lower cylinder 71 and has on an outer periphery thereof an outer-periphery protrusion 72*a* placed on an upper end of the lower cylinder 71, a plate-shaped intake valve 73 coupled to a lower end of an inner periphery of the upper cylinder 73, a piston support 74 which is a T-shaped member configured such that the fastening cylinder 62 of the lower lid 60 is inserted into and coupled to a cylindrical groove 74*c*, and which has on a center thereof a center hole 74*a* of which upper and lower parts communicate with each other, a piston rod 75 coupled to the center hole 74*a* of the piston support 74, a cylindrical valve 76 of which inner periphery is fitted into an outer periphery of a lower part of the piston rod 75, of which lower end is supported by a lower-end horizontal protrusion 75*a* of the piston rod 75, and of which outer periphery is in close contact with an inner periphery of the upper cylinder 72 so that the cylindrical valve moves up and down as the piston rod 75 moves up and down, and a spring 77 for a pump, of which lower end is supported by an outer-periphery protrusion 72*a* of the upper cylinder 72, and of which upper end is supported by a lower end of an upper surface of the piston support 74.

An inner hole 75*b* is formed through the center of the upper side of the piston rod 75, and a plurality of communication holes 75*c* communicating with the inner hole 75*b* is radially formed in the outer circumference of the upper side of the lower-end horizontal protrusion 75*a*.

A locking protrusion 74*b* formed on the inner periphery of the center hole 74*a* of the piston support 74 engages with a locking step 75*d* formed on the outer periphery of the piston rod 75.

In other words, if the piston rod 75 is inserted from the lower part of the piston support 74 into the center hole 74*a*, the locking step 75*d* rides over the locking protrusion 74*b* so as not to be removed downwards.

Furthermore, the inner diameter of the discharge hole 61 is formed smaller than the inner diameter of the fastening cylinder 62 of the lower lid 60, so that, when the piston support 74 and the lower lid 60 are coupled to each other, the upper end surface of the center hole 74*a* of the piston support 74 comes into close contact and overlaps with the lower surface of the discharge hole 61 in the fastening cylinder 62 of the lower lid 60, thus reinforcing fastening force.

Thus, as the fastening force is reinforced, external air is not introduced into the upper cylinder 72 even when the external air flows into a plurality of holes 51 of the upper lid 50.

As shown in FIGS. 9 and 10, a coupling protrusion 23*a* is formed on an outer periphery of an outer vertical protruding rod 23 among two vertical protruding rods 23 of the inner container 20 so that an outer side of an upper part of the container cover 30 is firmly coupled thereto. A gap, i.e. an evacuation space is formed between the inner periphery of the inner container 20 and an outer periphery of a lower part of the container cover 30 so that an upper end of the exhaustion piston 80 rising from the inner periphery of the inner container 20 is inserted.

The upper end of the exhaustion piston 80 is inserted into the evacuation space, thus allowing cosmetic contents to be fully used without waste.

The hole 51 of the disc-shaped upper lid 50 is formed of six holes, which are longitudinal holes having an inclination of 60° between major axes thereof (see FIG. 11).

Reference numeral 24 denotes an air inlet hole which is formed in a lower end of the inner container 20 and allows the inflow of external air to raise the exhaustion piston 80 as the cosmetic contents in the inner container 20 are exhausted.

The operation and effect of the present disclosure configured as described above will be described below.

First, if the opening/closing button 90 provided on the side wall of the lower container 10 is pressed so as to use the cosmetic container, the button spring 91 provided therein is compressed and the locking protrusion 92 provided on the upper end is pushed inwards to be removed from the locking groove 103 of the upper case 100, thus allowing the upper case 100 to be opened around a hinge.

If the upper lid 50 is pressed down after the upper case 100 is opened, the piston support 74 of the pump body 70 coupled to the lower lid 60 provided under the upper lid moves down, and the piston rod 75 coupled to the piston support also moves down. While the piston rod 75 moves down, it is spaced apart from the lower end of the cylindrical valve 76 installed on an outer periphery thereof. As the piston rod 75 moves down, a volume in the upper cylinder 72 is reduced, so that the cosmetic contents in the inner container 20 pass through the cylinder 22 of the inner container 20 and flow into an inlet hole 71*a* of the lower cylinder 71. As the volume in the upper cylinder 72 is reduced, a central part of the plate-shaped intake valve 73 moves up, so that the cosmetic contents are introduced through the hole of the outer periphery into the upper cylinder 72.

The cosmetic contents introduced in this way flow into a space between the lower-end horizontal protrusion 75*a* of the piston rod 75 and the cylindrical valve 76, flow through the communication hole 75*c* and the center hole 75*b* into the upper surface of the lower lid 60, and are discharged through the plurality of holes 51 of the upper lid 50. The cosmetic contents discharged through the holes 51 are put on the upper surface of the upper lid 50, and then are applied to the face using a puff or the like.

Although the foregoing description is merely for illustrative purposes, it is apparent to those skilled in the art that the present disclosure may be changed and modified in various ways without departing from the scope of the present disclosure, which is described in the following claims.

An airless cosmetic container of the present disclosure has effects of: preventing external air from flowing into an upper cylinder since the inner diameter of a discharge hole is formed to be smaller than the inner diameter of a fastening cylinder of a lower lid such that, when a piston support and the lower lid are coupled, the upper end surface of a center hole of the piston support comes in close contact with, that is, overlaps with the lower surface of the discharge hole in the fastening cylinder of the lower lid, so as to reinforce fastening force; and enabling cosmetic contents to be fully exhausted and used up without waste since a coupling protrusion is formed on the outer periphery of an outer vertical protruding rod among two vertical protruding rods of the inner container such that the outer side of the upper part of the container cover is firmly coupled thereto, and a gap, that is, an evacuation space is formed between the inner periphery of the inner container and the outer periphery of the lower part of the container cover such that the upper end of the exhaustion piston raised along the inner periphery of the inner container is inserted therein, and thus the upper end of the exhaustion piston is inserted into the evacuation space.

The invention claimed is:

1. An airless cosmetic container, comprising:

a lower container having an opened lower part;

an inner container which is a cylindrical member inserted through an upper opening of the lower container and having a closed lower part, and which has an upper outer flange mounted on and assembled to an upper end of the lower container;

a container cover which is a cylindrical member for covering the upper opening of the inner container, and of which a lower protruding groove protruding downwards from a center thereof is positioned in a cylinder protruding from a center of the inner container and an outer end is coupled to two vertical protruding rods protruding toward an upper part of the upper outer flange of the inner container;

a cylindrical spring coupled in the container cover;

a disc-shaped upper lid, having a recessed upper surface, coupled to an upper part of the cylindrical spring;

a disc-shaped lower lid, which is a member coupled to a lower surface of a center of the upper lid, has a discharge hole formed in the center thereof, and has a fastening cylinder formed at a lower part of the discharge hole;

a pump body coupled to the fastening cylinder of the lower lid and inserted into the lower protruding groove of the container cover;

an exhaustion piston coming in contact with an inner periphery of the inner container and an outer periphery of the cylinder protruding in the center thereof, so as to rise as cosmetic contents are used; and an upper case which is a cylindrical member for covering an upper side of the lower container, and of which one side is hinge-coupled to one side wall of the lower container and another side is hooked and coupled to an opening/closing button, wherein a coupling protrusion is formed on an outer periphery of an outer vertical protruding rod among two vertical protruding rods of the inner container so that an outer side of an upper part of the container cover is coupled thereto; and a gap is formed between the inner periphery of the inner container and an outer periphery of a lower part of the container cover so that an upper end of the exhaustion piston rising from the inner periphery of the inner container is inserted.

2. The airless cosmetic container of claim 1, wherein an inner diameter of the discharge hole is formed to be smaller than an inner diameter of the fastening cylinder of the lower lid, so that, when a piston support of the pump body is coupled to the lower lid, an upper end surface of a center hole of the piston support is in contact with a lower surface of the discharge hole in the fastening cylinder of the lower lid.

3. The airless cosmetic container of claim 1, wherein a hole of the disc-shaped upper lid is formed of six holes, which are longitudinal holes having an inclination of 60° between major axes thereof.

4. An airless cosmetic container, comprising:

a lower container having an opened lower part;

an inner container which is a cylindrical member inserted through an upper opening of the lower container and having a closed lower part, and which has an upper outer flange mounted on and assembled to an upper end of the lower container;

a container cover which is a cylindrical member for covering the upper opening of the inner container, and of which a lower protruding groove protruding downwards from a center thereof is positioned in a cylinder protruding from a center of the inner container and an outer end is coupled to two vertical protruding rods protruding toward an upper part of the upper outer flange of the inner container;

a cylindrical spring coupled in the container cover;

a disc-shaped upper lid, having a recessed upper surface, coupled to an upper part of the cylindrical spring;

a disc-shaped lower lid, which is a member coupled to a lower surface of a center of the upper lid, has a discharge hole formed in the center thereof, and has a fastening cylinder formed at a lower part of the discharge hole;

a pump body coupled to the fastening cylinder of the lower lid and inserted into the lower protruding groove of the container cover;

an exhaustion piston coming in contact with an inner periphery of the inner container and an outer periphery of the cylinder protruding in the center thereof, so as to rise as cosmetic contents are used; and an upper case which is a cylindrical member for covering an upper side of the lower container, and of which one side is hinge-coupled to one side wall of the lower container and another side is hooked and coupled to an opening/closing button, wherein the pump body comprises:

a lower cylinder which is a cylindrical member inserted into and coupled to a bottom in the lower protruding groove of the container cover, is opened at a top thereof, and has a cosmetic-content inflow hole formed in a center of a lower part thereof;

an upper cylinder which is a cylindrical member opened at upper and lower parts thereof coupled to an inner periphery of the lower cylinder, and has on an outer periphery thereof an outer-periphery protrusion placed on an upper end of the lower cylinder;

a plate-shaped intake valve coupled to a lower end of an inner periphery of the upper cylinder;

a piston support which is a T-shaped member configured such that the fastening cylinder of the lower lid is inserted into and coupled to a cylindrical groove, and which has on a center thereof a center hole of which upper and lower parts communicate with each other;

a piston rod coupled to the center hole of the piston support;

a cylindrical valve of which inner periphery is fitted into an outer periphery of a lower part of the piston rod, of which lower end is supported by a lower-end horizontal protrusion of the piston rod, and of which outer periphery is in contact with an inner periphery of the upper cylinder so that the cylindrical valve moves up and down as the piston rod moves up and down; and a spring for a pump, of which lower end is supported by an outer-periphery protrusion of the upper cylinder, and of which upper end is supported by a lower end of an upper surface of the piston support.

* * * * *